US006712749B1

(12) United States Patent
Michalik et al.

(10) Patent No.: US 6,712,749 B1
(45) Date of Patent: Mar. 30, 2004

(54) FOLDER

(75) Inventors: Horst Bernhard Michalik, Höchberg (DE); Manfred Wolfgang Hartmann, Elfershausen (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/169,729

(22) PCT Filed: Nov. 28, 2000

(86) PCT No.: PCT/DE00/04222

§ 371 (c)(1),
(2), (4) Date: Jul. 16, 2002

(87) PCT Pub. No.: WO01/55021

PCT Pub. Date: Aug. 2, 2001

(30) Foreign Application Priority Data

Jan. 25, 2000 (DE) ..... 100 03 025

(51) Int. Cl.[7] ..... B31F 1/10

(52) U.S. Cl. ..... 493/424; 493/475; 493/476; 493/479; 270/41

(58) Field of Search ..... 493/360–365, 493/356–359, 424, 439, 440, 476, 479, 478, 475; 270/40, 41, 52.14, 52.2, 5.01, 5.02, 5.03, 20.1, 21.1, 32

(56) References Cited

U.S. PATENT DOCUMENTS 1,186,970 A * 6/1916 Cottrell ..... 270/41
1,739,328 A * 12/1929 Roesen ..... 270/42
1,770,350 A * 7/1930 Jordhoy ..... 493/435
2,613,077 A * 10/1952 Smith, Jr. ..... 270/5.02
3,608,889 A * 9/1971 Woessner et al. ..... 493/360
4,779,859 A * 10/1988 Knauer ..... 270/41
5,016,863 A * 5/1991 Birkmair ..... 270/41
5,328,437 A 7/1994 Maylander et al.
5,469,788 A 11/1995 Michalik
5,503,379 A * 4/1996 Michalik et al. ..... 270/5.01
5,685,528 A * 11/1997 Weis ..... 270/6

FOREIGN PATENT DOCUMENTS

| | | | |
|---|---|---|---|
| DE | 668 877 | | 11/1938 |
| DE | 2 039 844 | | 8/1971 |
| DE | 28 08 483 | | 9/1978 |
| DE | G 92 17 956.8 | | 5/1993 |
| DE | 42 04 254 | A1 | 8/1993 |
| DE | 43 19 806 | A1 | 1/1995 |
| DE | 42 04 254 | C2 | 3/1995 |
| DE | 196 02 248 | A1 | 7/1997 |
| DE | 198 21 603 | A1 | 11/1999 |
| GB | 1354924 | * | 5/1974 |
| GB | 1 354 924 | | 5/1974 |
| JP | 56065760 | A | 6/1981 |

* cited by examiner

*Primary Examiner*—Stephen F. Gerrity
*Assistant Examiner*—Thanh Truong
(74) *Attorney, Agent, or Firm*—Jones, Tullar & Cooper, PC

(57) ABSTRACT

A longitudinal folding device includes formers for longitudinally forming and folding paper webs having different widths. Each former, together with its folding rollers, hopper roller and longitudinal cutting device is supported in a frame such that the former can be displaced in the axial directions of both the folding rollers and the hopper roller.

6 Claims, 2 Drawing Sheets

FOLDER

FIELD OF THE INVENTION

The present invention is directed to a folding apparatus having at least one longitudinal folding device . The longitudinal folding device is displaceable axially with respect to both hopper and folding rollers.

BACKGROUND OF THE INVENTION

Tabloid longitudinal cutting devices have become known from DE-PS 668 877. These tabloid cutting devices must be separately adjusted.

DE 198 21 603 A1 describes a longitudinal folding device. The folding hopper and associated folding rollers can be displaced in the axial direction of the folding rollers.

DE 92 17 956 U1 discloses a folding hopper. This folding hopper, together with folding rollers, can be moved transversely to the running direction of the paper web.

SUMMARY OF THE INVENTION

The object of the present invention is directed to producing a folding apparatus.

In accordance with the present invention, this object is attained by providing a folding apparatus with at least one longitudinal folding device. The longitudinal folding device has a folding hopper, a hopper roller, folding rollers and a longitudinal cutting device. The longitudinal folding device, including its components, is displaceable in the axial direction of the hopper roller as well as in the axial direction of the folding rollers .

The advantages which can be obtained by the present invention consist, in particular, in that, in the course of a tabloid production with changeable paper web widths, it is not necessary to adjust the individual processing devices for the paper web, or for the paper web strand consisting of several paper webs each time the paper web width changes.

Each folding hopper can be, at least, moved back and forth transversely to the running direction of the paper web. Each folding hopper, together with the folding rollers, the hopper inlet roller, as well as a longitudinal cutting device, together constitute a displaceable longitudinal folding device, so that following the lateral or other displacement of the displaceable longitudinal folding device or devices, an alignment of the individual processing device for the paper web, or for the paper web strand consisting of several paper webs, can be omitted.

BRIEF DESCRIPTION OF THE DRAWINGS

A preferred embodiment of the present invention is depicted in the drawings and will be described in greater detail in what follows. Shown are in.

DESCRIPTION OF THE PREFERRED EMBODIMENT

Figure 1:
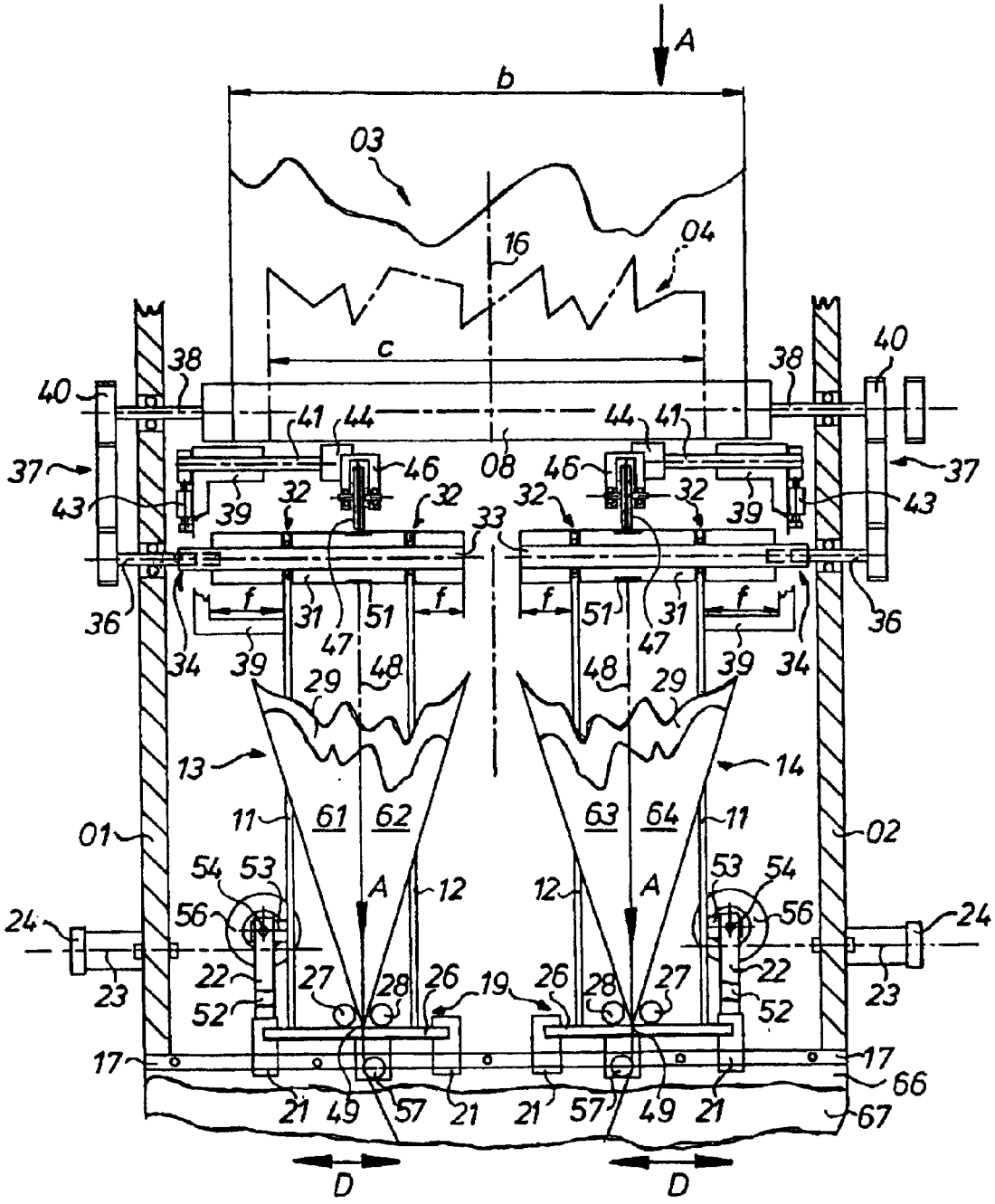
FIG. 1, a front elevation view of an adjustable longitudinal folding device with two folding hoppers, and in FIG. 2, a side elevation view in accordance with FIG. 1, but without the lateral frame and with a complete representation of the lateral walls of the folding unit.
Figure 2:
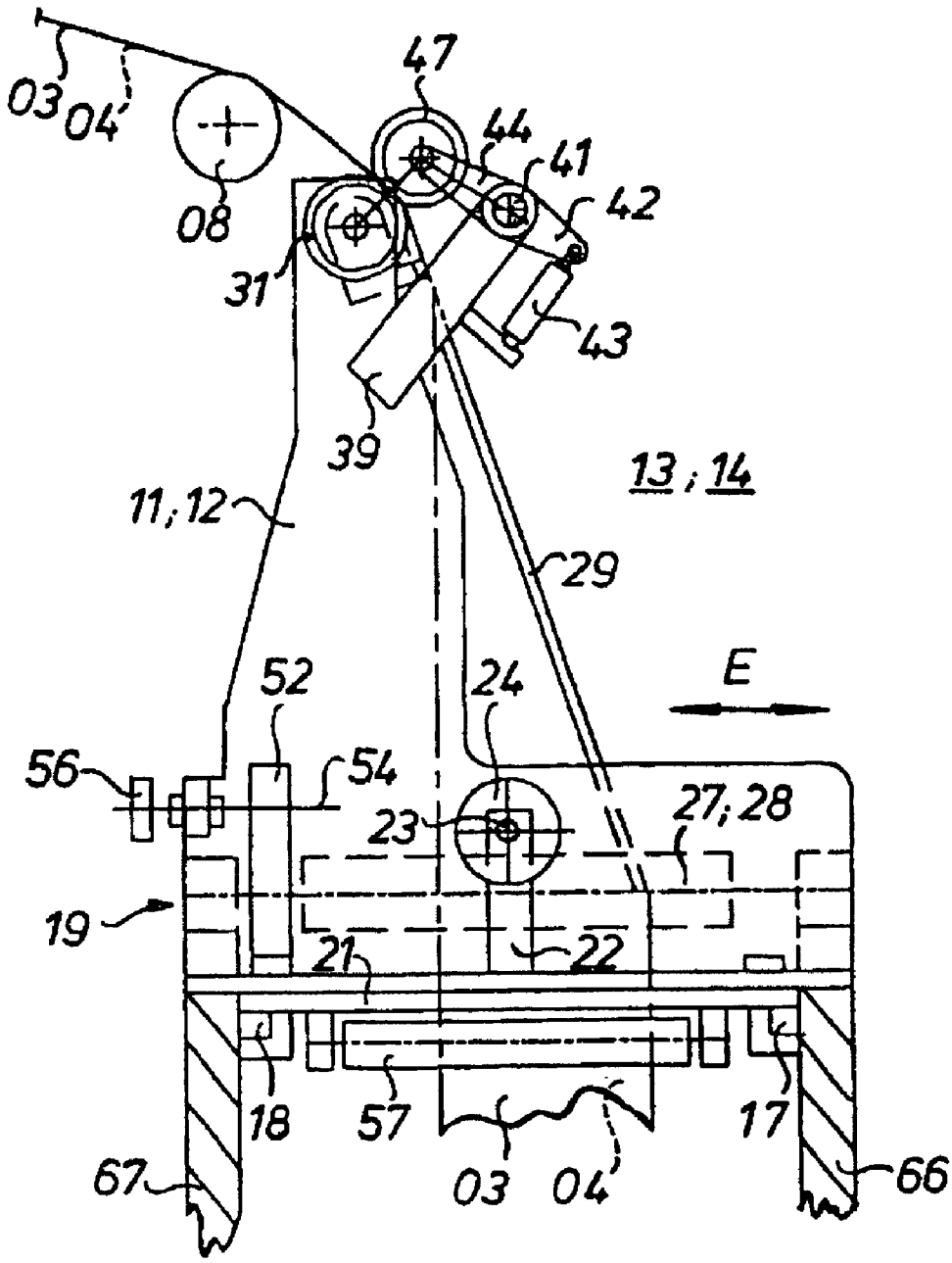

A hopper inlet roller 08, also with traction rollers, not specifically represented, is rotatably arranged between lateral frames 01, 02 of a web-fed rotary printing press in the paper running direction A of a paper web 03 or 04, each of 1/1 width "b" or of a width "c", as seen in FIGS. 1 and 2.

A first frame 11 and a second frame 12 cooperate to receive each of respective left and right longitudinal folding devices 13, 14. This is shown most clearly in FIG. 1. The longitudinal folding devices 13, 14 are arranged laterally reversed, or mirror images of each other, in relation to a center line 16 of the inner distance between the lateral frames 01, 02. The two longitudinal folding devices 13, 14 are situated between the lateral frames 01, 02. They are identically equipped. For reasons of simplicity, the same reference symbols are used for the components of the left and right longitudinal folding device, 13,14.

Guide rails 17, 18 are arranged extending between the two lateral frames 01, 02. Each guide rail 17, 18 extends parallel with a lateral wall 66, 67 of the folding unit, as seen most clearly in FIG. 2. The guide rails 17, 18 each have a cross support 19. This cross support 19 has a displaceable lower carriage 21, which is guided on the guide rails 17, 18. The displaceable lower carriage 21 is arranged to be displaceable in an axial direction D of the hopper inlet roller 08 and thus transversely to the paper web running direction A, by operation of, for example, an arm 22 and by utilization of a threaded spindle 23 joined to the lateral frame 01, or 02, and a drive mechanism 24. In this case, the drive mechanism 24 can consist of a handwheel 24 or of a motor, not specifically represented, which is arranged, fixed in place, on the lateral frame 01, 02.

An upper carriage 26, on which the folding rollers 27, 28 are seated, is arranged on the lower carriage 21 of the cross support 19. The upper carriage 26 is arranged to be movable back and forth in the axial direction E of the folding rollers 27, 28 as seen in FIG. 2. The first and second frames 11, or 12, each with a folding hopper 29 of a respective right or left longitudinal folding device, are fastened on the upper carriage 26. A hopper roller 31 is supported at the upper end of each frame 11, 12, wherein bearings 32 for each hopper roller 31 are each arranged at a distance "f" of, for example 50 mm, away from the end of the hopper roller 31. Each bearing 32 is located on a continuous shaft 33 supporting the hopper roller 31.

Each hopper roller 31 is driven via an end of its respective shaft 33 which is connected with a driveshaft 36 that is seated, fixed in place, on the lateral frames, via a universal joint 34 which is provided with a length compensation device.

The driveshaft 36 can be connected with a separate drive mechanism 37, for example an electric motor, or, as represented, driving of driveshaft 36 can also be accomplished using toothed belts, which connect the shafts 33, 38 of the hopper roller 31 and the hopper inlet roller 08 via toothed pulleys. In this case a separate drive of the hopper inlet roller shaft 38 is provided via drive means, for example a gear wheel 40.

A holder 39, which is provided in an approximate U-shape and which is fastened on the frame 11 or 12, as seen in FIGS. 1 or 2, has, at its end remote from the frame 11 or 12, a shaft 41 extending in the axial direction of the hopper roller 31. A first lever 42 is arranged, fixed in place on the shaft 41, at a first end of the shaft 41, as seen most clearly in FIG. 2, and on whose end remote from the shaft 41 the piston rod of a work cylinder 43, seated on the holder, is hinged. A second lever 44, which is fixed in place on the shaft 41 and which is arranged offset by approximately 180° in respect to the first lever 42, supports an upper blade 47 of a longitudinal cutting device in a fork-shaped upper blade holder 46.

The upper blade 47 is located above the hopper roller 31 and in the alignment line 48 of the funnel nose 49 of each of the left and the right longitudinal folding devices 13,14. The upper blade 47 can be placed against a cutting-ring-shaped lower blade 51 of the longitudinal cutting device which lower blade 51 is located on the hopper roller 31.

The upper carriage 26 can be moved back and forth in relation to the lower carriage 21 by the operation of a threaded spindle 54, joined fixed to the frame 11, and a drive mechanism 56. Each upper carriage 26 can move in the axial direction E of the folding rollers 27, 28. The threaded spindle 54 operates between a tongue 53 located on the frame 11, 12 and a guide lever 52 arranged on the lower carriage 21. The drive mechanism 56 can be embodied as an electric motor, not specifically represented, which is fixed in place on the frame 11, or as a handwheel 56.

The lower carriage 21 also has a paper run-out roller 57 on its underside.

Both lower carriage 21 and upper carriage 26 can be guided in dovetailed grooves. As represented in the drawings, it is, for example, also possible for the lower carriage 21 to extend laterally around the upper carriage 26, or the guide rails 17, 18.

If a paper web 03 of a width "b", or a paper web strand, is inserted into the left and right longitudinal folding devices 13, 14, which are provided with the two folding hoppers 29, it will be understood that the paper web 03 of width "b" has already been halved, or cut into two longitudinal web segments, at a longitudinal center line 16 by the use of a longitudinal cutting device, not specifically represented.

The two longitudinal folding devices 13, 14 are in the position represented in FIG. 1. The longitudinally halved paper web 03 is now able to be cut into partial paper webs 61 to 64, for example for tabloid products, by the longitudinal cutting device 47, 51 which are arranged above each of the folding hoppers 29 of their respective left and right longitudinal folding devices 13, 14.

If it is intended to produce tabloid products of a narrower width, for example from a paper web 04 of a width "c", the left and right longitudinal folding devices 13, 14 will be displaced toward each other in the axial direction D of the hopper inlet roller 08 by operation of the displaceable lower carriages 21. In the process, the longitudinal cutting device 47, 51 assigned to each folding hopper 29 moves together with the folding hopper 29 in the desired direction D, and also in the axial direction E of the folding rollers 27, 28 if the displaceable upper carriages 26 are operated to move the lower ends of the longitudinal folding devices 13, 14 in the axial direction E.

If it is necessary to assign signatures, resulting from the operation of a device for forming a second longitudinal fold, in subsequent work steps to an outgoing paper web strand made of partial paper webs 61, 62, or 63, 64, it is advantageous, as a function of the format of the signatures to be assigned, if the longitudinal folding device 13, 14 is embodied so it can also be adjusted in the axial direction E of the folding rollers 27, 28, as represented in FIG. 2. As discussed above, this movement in the axial direction E is accomplished by operation of the upper carriage 26 for the lower end of each of the left and right longitudinal folding devices 13, 14.

While a preferred embodiment of a folding apparatus in accordance with the present invention has been set forth fully and completely hereinabove, it will be apparent to one of skill in the art that various changes, in, for example the specific type of printing press used to print the paper web or webs, the drive for the press, and the like can be made without departing from the true spirit and scope of the present invention which is accordingly to be limited only by the following claims.

List of Reference Symbols

1 Lateral frame
2 Lateral frame
3 Paper web, strand
4 Paper web,strand
5—
6—
7—
8 Hopper inlet roller
9 Traction roller
10—
11 Frame, first (13, 14)
12 Frame, second (13, 14)
13 Longitudinal folding device, left
14 Longitudinal folding device, right
15—]
[16 Center line (03, 04)
17 Guide rail (13, 14)
18 Guide rail (13, 14)
19 Cross supports (16,17)
20—
21 Carriage, lower (19)
22 Arm
23 Threaded spindle (21)
24 Drive mechanism (23)
25—
26 Carriage, upper
27 Folding roller (26)
28 Folding roller (26)
29 Folding hopper (11, 12)
30—
31 Hopper roller (11, 12)]
[32 Bearing (31)
33 Shaft (31)
34 Universal joint (33)
35—
36 Driveshaft
37 Drive mechanism (36)
38 Shaft (08)
39 Holder (11, 12)
40 Gear wheel (37)
41 Shaft (39)
42 Lever, first (41)
43 Work cylinder (42, 39)
44 Lever, second (41)
45—
46 Holder, fork-shaped
47 Upper blade]
[48 Alignment line (49)
49 Hopper nose
50—
51 Lower blade (31)
52 Guide lever (21)
53 Tongue(11,12)
54 Threaded spindle
55—
56 Drive mechanism (54)
57 Paper run-out roller
58—
59—
60—
61—Partial paper web (03)

62—Partial paper web (03)
63—Partial paper web (03)]
[—Partial paper web (03)
65—
66 Lateral wall, folding unit
67 lateral wall, folding unit
A Paper web running direction (03, 04)
D Direction, axial
E Axial direction (27, 28)
b Width (03)
c Width (04)
f Distance]

What is claimed is:

1. A folding apparatus comprising:

at least one longitudinal folding device, said at least one longitudinal folding device including a hopper roller having a hopper roller axis of rotation, a pair of folding rollers having folding roller axes of rotation, a folding hopper situated between said hopper roller and said pair of folding rollers and a longitudinal cutting device; and means supporting said at least one longitudinal folding device, including said hopper roller, said pair of folding rollers, said folding hopper and said longitudinal cutting device for displacement of said at least one longitudinal folding device in a first axial direction of said hopper roller axis of rotation and in a second axial direction of said folding rollers axes of rotation, said first axial direction and said second axial direction being different from each other.

2. The folding apparatus of claim 1 wherein said at least one longitudinal folding device, including said hopper roller, said longitudinal cutting device and said pair of folding rollers, is arranged in a displaceable frame.

3. The folding apparatus of claim 2 further including a cross support for said displaceable frame.

4. The folding apparatus of claim 1 wherein said longitudinal cutting device includes an upper blade and a lower blade, said lower blade being supported on said hopper roller and said upper blade being supported for pivotal movement toward and away from said lower blade.

5. The folding apparatus of claim 1 further including a second longitudinal folding device.

6. The folding apparatus of claim 5 further including a hopper inlet roller extending over an entire width of said at least one and second longitudinal folding devices.

* * * * *